United States Patent [19]

Schleich et al.

[11] Patent Number: 5,040,552

[45] Date of Patent: Aug. 20, 1991

[54] METAL CARBIDE HEAT SOURCE

[75] Inventors: Donald M. Schleich; Yunchang Zhang, both of Brooklyn, N.Y.

[73] Assignee: Philip Morris Incorporated, New York, N.Y.

[21] Appl. No.: 281,496

[22] Filed: Dec. 8, 1988

[51] Int. Cl.[5] ..... A24B 15/16; A24D 1/18

[52] U.S. Cl. ..... 131/359; 131/369; 131/352

[58] Field of Search ..... 131/352, 359, 369, 194; 75/542

[56] References Cited

U.S. PATENT DOCUMENTS

| | | | |
|---|---|---|---|
| 2,907,686 | 10/1959 | Seigel . | |
| 3,256,094 | 9/1965 | Ellis et al. . | |
| 3,258,015 | 6/1966 | Ellis et al. . | |
| 3,572,993 | 3/1971 | Rogers . | |
| 3,943,941 | 3/1976 | Boyd et al. . | |
| 4,310,334 | 1/1982 | Waldron . | |
| 4,340,072 | 7/1982 | Bolt et al. . | |
| 4,477,278 | 10/1984 | Agrawal | 75/542 |
| 4,584,323 | 10/1985 | Soled et al. . | |
| 4,621,002 | 4/1986 | Soled et al. . | |
| 4,621,002 | 11/1986 | Fiato et al. . | |
| 4,687,753 | 8/1987 | Fiato et al. . | |
| 4,708,151 | 11/1987 | Shelar . | |
| 4,714,082 | 12/1987 | Banerjee et al. . | |
| 4,799,979 | 1/1989 | Baldi . | |
| 4,842,759 | 6/1989 | Okamura et al. . | |

FOREIGN PATENT DOCUMENTS

| | | |
|---|---|---|
| 0117355 | 9/1984 | European Pat. Off. . |
| 0123318 | 10/1984 | European Pat. Off. . |
| 0154903 | 9/1985 | European Pat. Off. . |
| 0180162 | 5/1986 | European Pat. Off. . |
| 0236992 | 9/1987 | European Pat. Off. . |
| 0245732 | 11/1987 | European Pat. Off. . |
| 1573454 | 8/1980 | United Kingdom . |

OTHER PUBLICATIONS

J. A. Amiese et al., "Mössbauer Spectroscopic Study of Passivated Small Particles of Iron and Iron Carbide", *The Journal of Physical Chemistry,* 85, pp. 2484–2488 (1981).

J. A. Amiese, J. B. Butt and L. H. Schwartz, "Carburization of Supported Iron Synthesis Catalysts", *The Journal of Physical Chemistry,* 82, pp. 558–563 (1978).

M. Audier, P. Bowen, and W. Jones, "Transmission Electronic Microscope Study of Single Crystal of $Fe_7C_3$", *Journal of Crystal Growth,* 63, pp. 125–134 (1983) (Audier et al., I).

M. Audier, P. Bowen and W. Jones, "Electronic Microscopic and Mössbauer Study of the Iron Carbide —$Fe_3C$ and —$Fe_5C_2$ Formed During the Disproportionation of CO", *Journal of Crystal Growth,* 64, pp. 291–296 (1983) (Audier et al., II).

G. H. Barton and B. Gale, "The Structure of a Psuedo--Hexagonal Iron Carbide", *Acta Crystallographica,* 17, pp. 1460–1462 (1964).

H. Bernas, I. A. Campbell and R. Fruchart, "Electronic Exchange and the Mossbauer Effect in Iron-Based Interstitial Compounds", *Journal of Physical Chemistry of Solids,* 28, pp. 17–24 (1967).

J. P. Bouchaud and R. Fruchart, "Contribution à la Connaissance du Diagramme Manganese-Carbone", *Bulletin de la Sociétē Chimique de France,* pp. 1579–1583 (1964).

(List continued on next page.)

*Primary Examiner*—V. Millin

*Attorney, Agent, or Firm*—Denise L. Loring; Marta E. Gross

[57] ABSTRACT

An iron carbide heat source, particularly useful in smoking articles, is provided. The iron carbide particles making up the heat source have ignition temperatures that are substantially lower than conventional carbon particles normally used in carbonaceous heat sources, while at the same time provide sufficient heat to release a flavored aerosol from a flavor bed for inhalation by the smoker. In a preferred embodiment, the iron carbide heat source of this invention is substantially cylindrical in shape and has one or more fluid passages therethrough. Upon combustion, the heat source produces substantially no carbon monoxide.

18 Claims, 2 Drawing Sheets

OTHER PUBLICATIONS

"Carbides", *The Encyclopedia Brittanica,* 1965, pp. 862–863 and 600–601.

P. Courty and B. Delmon, "Obtention d'Oxydes Mixtes par Decomposition de Precurseurs Amorphes (sels organiques amorphes)", *C. R. Acad. Sc. Paris, Ser. C,* 268, pp. 1874–1875 (1969).

R. A. Dictor and A. T. Bell, Fischer–Tropsch "Synthesis over Reduced and Unreduced Iron Oxide Catalysts", *Journal of Catalysis,* 97, pp. 121–136 (1986).

M. J. Duggin and L. J. E. Hofer, "Nature of $\chi$-Iron Carbide", *Nature,* 212, pp. 248–250 (1966).

D. J. Dwyer and J. H. Hardenbergh, "The Catalytic Production of Carbon Monoxide Over Iron Surfaces: A Surface Science Investigation", *Journal of Catalysis,* 87, pp. 66–76 (1984).

R. Fruchart, "Le Rôle du Facteur Electronique dans les Structures du Type Cémentite et les Structures Dérivées", *Bulletin de la Societe Chimique de France,* pp. 2652–2657 (1964).

R. R. Gatte and J. Phillips, "The Influence of Particle Size and Structure on the Mossbauer Spectra of Iron Carbides Formed During fischer–Tropsch Synthesis", *Journal of Catalysis,* 104, pp. 365–374 (1987).

F. H. Herbstein and J. A. Snyman, "Identification of Eckstrom Adcock Iron Carbide as $Fe_7C_3$", *Inorganic Chemistry,* 3, pp. 894–896 (1964).

Y. Hirotsu and S. Magakura, "Crystal Structure and Morphology of the Carbide Precipitated from Martensitic High Carbon Steel During the First Stage of Tempering", *Acta Metallurgica,* 20, pp. 645–654 (1972).

L. J. E. Hofer, E. M. Cohn, and W. C. Peebles, "The Modifications of the Carbide, $Fe_2C$; Their Properties and Identification", *Journal of the American Chemical Society,* 71, pp. 189–195 (1949).

A. J. H. M. Kock et al., "The Formation of Filamentous Carbon on Iron and Nickel Catalysts", *Journal of Catalysis,* 96, pp. 468–480 (1985).

T. Ya. Kosolapova, *Carbides: Properties, Production and Applications,* pp. 171–177, Plenum Press, New York 1971.

G. LeCaer, J. M. Dubois, and J. P. Senateur, "Etude par Spectrométrie Mössbauer des Carbures de Fer $Fer_3C$ et $Fer_5C_2$", *Journal of Solid State Chemistry,* 19, pp. 19–28 (1976).

S. C. Lin and J. Phillips, "Study of Relaxation Effects in the $^{57}Fe$ Mossbauer Spectra of Carbon–Supported Iron Carbide Particles", *Journal of Applied Physics,* 58, pp. 1943–1949 (1985).

A. Michel, "Properties et Liaisons Dans ls Carbures de Fer", *Bulletin de la Sociētē Chimique de France,* pp. 143–147 (1961).

J. W. Niemantsverdreit et al., "Behavior of Metallic Iron Catalysts During Fischer–Tropsch Synthesis Studied with Mössbauer Spectroscopy, X-Ray Diffraction, Carbon Content Determination, and Reaction Kinetic Measurements", *The Journal of Physical Chemistry,* 84, pp. 3363–3371 (1980).

J. P. Senateur, "Contribution a L'Etude Magnetique et Structurale du Carbure de Hägg", *Annales de Chimie,* 2, pp. 103–122 (1967).

W. W. Webb, J. T. Norton and C. Wagner, "Oxidation Studies in Metal–Carbon Systems", *Journal of the Electrochemical Society,* 103, pp. 112–117 (1956).

D. V. Wilson, "Relation of Changes in the Cementite Curie Temperature to Textural Strains in Steel", *Nature,* 167, pp. 899–900 (1951).

E. Yeh et al., "Silica–Supported Iron Nitride in Fischer–Tropsch Reactions", *Journal of Catalysis,* 91, pp. 231–240 (1985).

METAL CARBIDE HEAT SOURCE

BACKGROUND OF THE INVENTION

This invention relates to a heat source which is particularly useful in smoking articles. More particularly, this invention relates to metal carbide heat sources which, upon combustion, produce substantially no carbon monoxide. The metal carbide particles making up the heat sources of this invention have ignition temperatures that are substantially lower than conventional carbon particles normally used in carbonaceous heat sources, while at the same time provide sufficient heat to release a flavored aerosol from a flavor bed for inhalation by the smoker. This invention is particularly suitable for use in a smoking article such as that described in copending U.S. patent application Ser. No. 223,153, filed on July 22, 1988.

There have been previous attempts Lo provide a heat source for a smoking article. While providing a heat source, these attempts have not produced a heat source having all of the advantages of the present invention.

For example, Siegel U.S. Pat. No. 2,907,686 discloses a charcoal rod coated with a concentrated sugar solution which forms an impervious layer during burning. It was thought that this layer would contain gases formed during smoking and concentrate the heat thus formed.

Ellis et al. U.S. Pat. No. 3,258,015 and Ellis et al. U.S. Pat. No. 3,356,094 disclose a smoking device comprising a nicotine source and a tobacco heat source.

Boyd et al. U.S. Pat. No. 3,943,941 discloses a tobacco substitute which consists of a fuel and at least one volatile substance impregnating the fuel. The fuel consists essentially of combustible, flexible and self-coherent fibers made of a carbonaceous material containing at least 80% carbon by weight. The carbon is the product of the controlled pyrolysis of a cellulose-based fiber containing only carbon, hydrogen and oxygen.

Bolt et al. U.S. Pat. No. 4,340,072 discloses an annular fuel rod extruded or molded from tobacco, a tobacco substitute, a mixture of tobacco substitute and carbon, other combustible materials such as wood pulp, straw and heat-treated cellulose or a sodium carboxymethylcellulose (SCMC) and carbon mixture.

Shelar et al. U.S. Pat. No. 4,708,151 discloses a pipe with replaceable cartridge having a carbonaceous fuel source. The fuel source comprises at least 60–70% carbon, and most preferably 80% or more carbon, and is made by pyrolysis or carbonization of cellulosic materials such as wood, cotton, rayon, tobacco, coconut, paper and the like.

Banerjee et al. U.S. Pat. No. 4,714,082 discloses a combustible fuel element having a density greater than 0.5 g/cc. The fuel element consists of comminuted or reconstituted tobacco and/or a tobacco substitute, and preferably contains 20–40% by weight of carbon.

Published European patent application 0 117 355 by Hearn et al. discloses a carbon heat source formed from pyrolized tobacco or other carbonaceous material such as peanut shells, coffee bean shells, paper, cardboard, bamboo, or oak leaves.

Published European patent application 0 236 992 by Farrier et al. discloses a carbon fuel element and process for producing the carbon fuel element. The carbon fuel element contains carbon powder, a binder and other additional ingredients, and consists of between 60 and 70% by weight of carbon.

Published European patent application 0 245 732 by White et al. discloses a dual burn rate carbonaceous fuel element which utilizes a fast burning segment and a slow burning segment containing carbon materials of varying density.

These heat sources are deficient because they provide unsatisfactory heat transfer to the flavor bed, resulting in an unsatisfactory smoking article, i.e., one which fails to simulate the flavor, feel and number of puffs of a conventional cigarette.

Copending U.S. patent application Ser. No. 223,232, filed on July 22, 1988, solved this problem by providing a carbonaceous heat source formed from charcoal that maximizes heat transfer to the flavor bed, releasing a flavored aerosol from the flavor bed for inhalation by the smoker, while minimizing the amount of carbon monoxide produced.

However, all conventional carbonaceous heat sources liberate some amount of carbon monoxide gas upon ignition. Moreover, the carbon contained in these heat sources has a relatively high ignition temperature, making ignition of conventional carbonaceous heat sources difficult under normal lighting conditions for a conventional cigarette.

Attempts have been made to produce non-combustible heat sources for smoking articles, in which heat is generated electrically. E.g., Burruss, Jr., U.S. Pat. No. 4,303,083, Burruss U.S. Pat. No. 4,141,369, Gilbert U.S. Pat. No. 3,200,819, McCormick U.S. Pat. No. 2,104,266 and Wyss et al. U.S. Pat. No. 1,771,366. These devices are impractical and none has met with any commercial success.

It would be desirable to provide a heat source that liberates virtually no carbon monoxide upon combustion.

It would also be desirable to provide a heat source that has a low temperature of ignition to allow for easy lighting under conditions typical for a conventional cigarette, while at the same time providing sufficient heat to release flavors from a flavor bed.

It would further be desirable to provide a heat source that does not self-extinguish prematurely.

SUMMARY OF THE INVENTION

It is an object of this invention to provide a heat source that liberates virtually no carbon monoxide gas upon combustion.

It is also an object of this invention to provide a heat source that has an ignition temperature lower than that of conventional heat sources.

It is yet another object of this invention to provide a heat source that does not self-extinguish prematurely.

In accordance with this invention, there is provided a heat source, which is particularly useful in a smoking article. The heat source is formed from materials having a substantial metal carbide content, particularly an iron carbide, and more particularly an iron carbide having the formula $Fe_xC$, where x is between 2 and 3. The heat source may have one or more longitudinal passageways, as described in copending U.S. patent application Ser. No. 223,232, filed on July 22, 1988, or may have one or more grooves around the circumference of the heat source such that air flows along the outside of the heat source. Alternatively, the heat source could be formed with a porosity sufficient to allow heat flow through the heat source. When the heat source is ignited and air is drawn through the smoking article, the air is heated as it passes around or through the heat source or through, over or around the air flow passageways or grooves. The heated air flows through a flavor bed, releasing a flavored aerosol for inhalation by the smoker.

Metal carbides are hard, brittle materials, which are readily reducible to powder form. Iron carbides consist of at least two well-characterized phases—$Fe_5C_2$, also known as Hägg's compound, and $Fe_3C$, referred to as cementite. The iron carbides are highly stable, interstitial crystalline molecules and are ferromagnetic at room temperature. $Fe_5C_2$ has a reported monoclinic crystal structure with cell dimensions of 11.56 angstroms by 4.57 angstroms by 5.06 angstroms. The angle $\beta$ is 97.8 degrees. There are four molecules of $Fe_5C_2$ per unit cell. $Fe_3C$ is orthorhombic with cell dimensions of 4.52 angstroms by 5.09 angstroms by 6.74 angstroms. $Fe_5C_2$ has a Curie temperature of about 248 degrees centigrade. The Curie temperature of $Fe_3C$ is reported to be about 214 degrees centigrade. J. P. Senateur, *Ann. Chem.*, vol. 2, p. 103 (1967).

Upon combustion, the metal carbides of the heat source of this invention liberate substantially no carbon monoxide. While not wishing to be bound by theory, it is believed that essentially complete combustion of the metal carbide produces metal oxide and carbon dioxide, without production of any significant amount of carbon monoxide.

In a preferred embodiment of this invention, the heat source comprises iron carbide, preferably rich in carbides having the formula $Fe_5C_2$. Other metal carbides suitable for use as a heat source in this invention are carbides of aluminum, titanium, manganese, tungsten and niobium, or mixtures thereof. Catalysts and oxidizers may be added to the metal carbide to promote complete combustion and to provide other desired burn characteristics.

While the metal carbide heat sources of this invention are particularly useful in smoking devices, it is to be understood that they are also useful as heat sources for other applications, where having the characteristics described herein are desired.

BRIEF DESCRIPTION OF THE DRAWINGS

The above and other objects and advantages of this invention will be apparent upon consideration of the following detailed description, taken in conjunction with the accompanying drawings, in which like reference characters refer to like parts throughout, and in which.

DETAILED DESCRIPTION OF THE INVENTION

Figure 1:
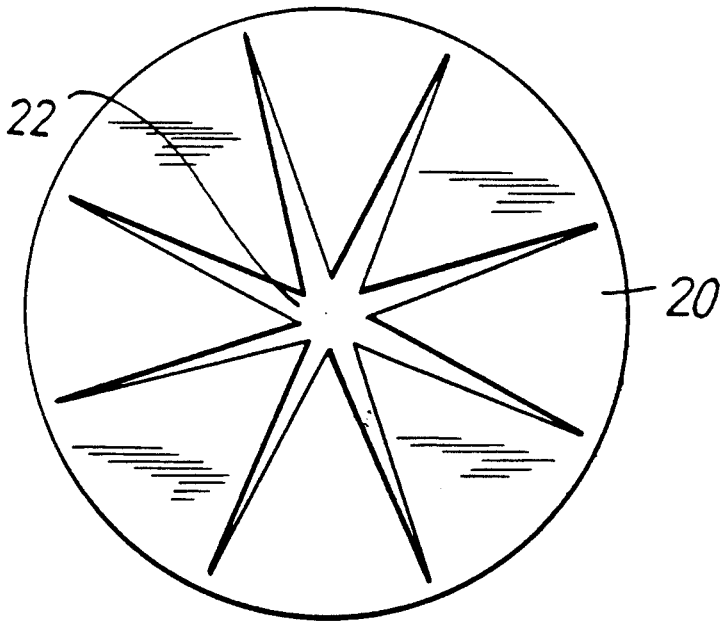
FIG. 1 depicts an end view of one embodiment of the heat source of this invention.
Figure 2:
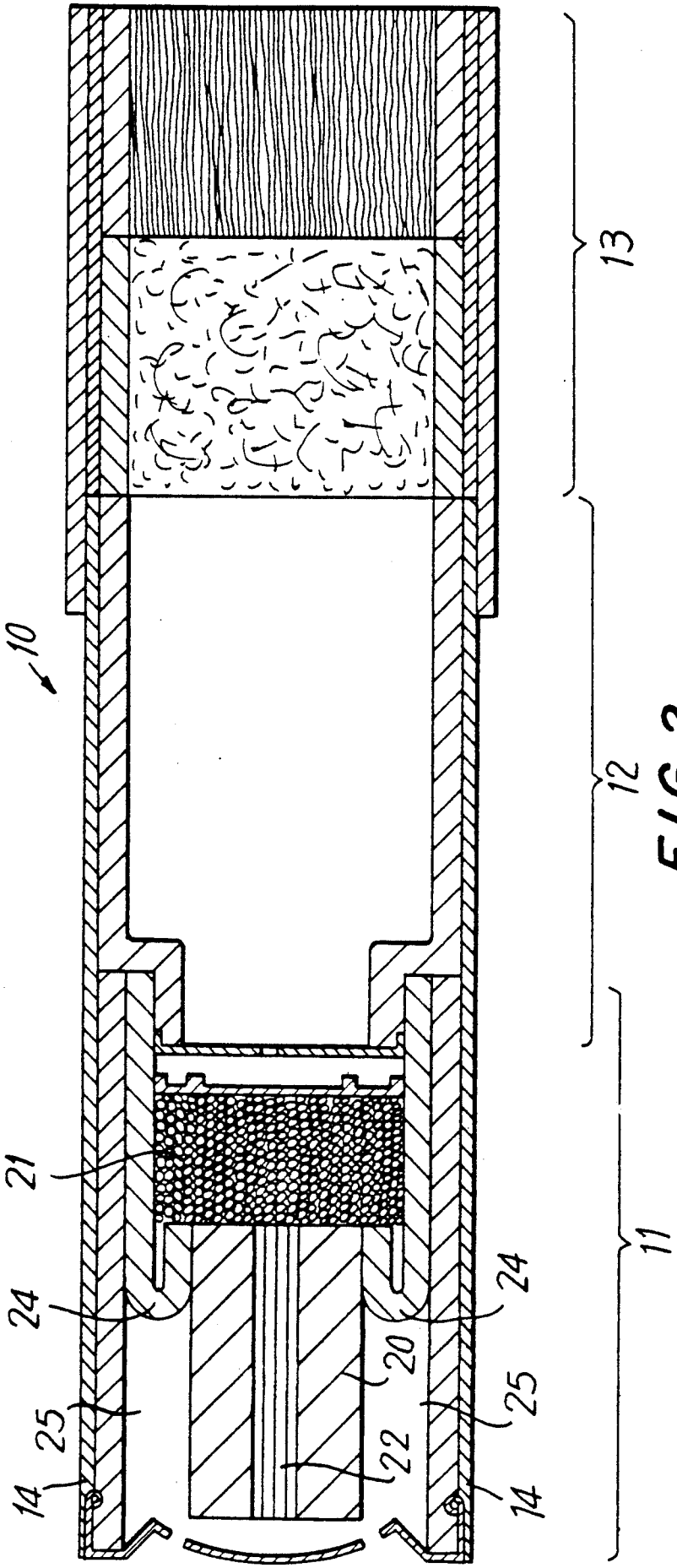
FIG. 2 depicts a longitudinal cross-sectional view of a smoking article in which the heat source of this invention may be used.

Smoking article 10 consists of an active element 11, an expansion chamber tube 12, and a mouthpiece element 13, overwrapped by a cigarette wrapping paper 14. Active element 11 includes a metal carbide heat source 20 and a flavor bed 21 which releases flavored vapors when contacted by hot gases flowing through heat source 20. The vapors pass into expansion chamber tube 12, forming an aerosol that passes to mouthpiece element 13, and then into the mouth of a smoker.

Heat source 20 should meet a number of requirements in order for smoking article 10 to perform satisfactorily. It should be small enough to fit inside smoking article 10 and still burn hot enough to ensure that the gases flowing therethrough are heated sufficiently to release enough flavor from flavor bed 21 to provide flavor to the smoker. Heat source 20 should also be capable of burning with a limited amount of air until the metal carbide in the heat source is expended. Upon combustion, heat source 20 should produce virtually no carbon monoxide gas.

Heat source 20 should have an appropriate thermal conductivity. If too much heat is conducted away from the burning zone to other parts of the heat source, combustion at that point will cease when the temperature drops below the extinguishment temperature of the heat source, resulting in a smoking article which is difficult to light and which, after lighting, is subject to premature self-extinguishment. Such extinguishment is also prevented by having a heat source that undergoes essentially 100% combustion. The thermal conductivity should be at a level that allows heat source 20, upon combustion, to transfer heat to the air flowing through it without conducting heat to mounting structure 24. Oxygen coming into contact with the burning heat source will almost completely oxidize the heat source, limiting oxygen release back into expansion chamber tube 12. Mounting structure 24 should retard oxygen from reaching the rear portion of the heat source 20, thereby helping to extinguish the heat source after the flavor bed has been consumed. This also prevents the heat source from falling out of the end of the smoking article.

Finally, ease of lighting is also accomplished by having a heat source with an ignition temperature sufficiently low to permit easy lighting under normal conditions for a conventional cigarette.

The metal carbides of this invention generally have a density of between 2 and 10 gr/cc and an energy output of between 1 and 10 kcal/gr., resulting in a heat output of between 2 and 20 kcal/cc. This is comparable to the heat output of conventional carbonaceous materials. These metal carbides undergo essentially 100% combustion, producing only metal oxide and carbon dioxide gas, with substantially no liberation of carbon monoxide gas. They have ignition temperatures of between room temperature and 550 degrees centigrade, depending on the chemical composition, particle size, surface area and Pilling Bedworth ratio of the metal carbide.

Thus, the preferred metal carbides for use in the heat source of this invention are substantially easier to light than conventional carbonaceous heat sources and less likely to self-extinguish, but at the same time can be made to smolder at lower temperatures.

The rate of combustion of the heat source made from metal carbides can be controlled by controlling the particle size, surface area and porosity of the heat source material and by adding certain materials to the heat source. These parameters can be varied to minimize the occurrence of side reactions in which free carbon may be produced and thereby minimize production of carbon monoxide that may form by reaction of the free carbon with oxygen during combustion. Such methods are well-known in the art.

For example, the metal carbide in heat source 20 may be in the form of small particles. Varying the particle size will have an effect on the rate of combustion. The smaller the particles are, the more reactive they become because of the greater availability of surface to react with oxygen for combustion. This results in a more efficient combustion reaction. The size of these particles can be up to about 700 microns. Preferably the metal carbide particles have an average particle size of about submicron to about 300 microns. The heat source may be synthesized at the desired particle size, or, alternatively, synthesized at a larger size and ground down to the desired size.

The B.E.T. surface area of the metal carbide also has an effect on the reaction rate. The higher the surface area, the more rapid the combustion reaction. The B.E.T. surface area of heat source 20 made from metal carbides should be between 1 and 400 $m^2/gr$, preferably between about 10 and 200 $m^2/gr$.

Increasing the void volume of the metal carbide particles will increase the amount of oxygen available for the combustion reaction, thereby increasing the reaction rate. Preferably, the void volume is from about 25% to about 75% of the theoretical maximum density.

Heat loss to the surrounding wrapper 14 of smoking article 10 may be minimized by insuring that an annular air space is provided around heat source 20. Preferably heat source 20 has a diameter of about 4.6 mm and a length of 10 mm. The 4.6 mm diameter allows an annular air space around the heat source without causing the diameter of the smoking article to be larger than that of a conventional cigarette.

In order to maximize the transfer of heat from the heat source to flavor bed 21, one or more air flow passageways 22 may be formed through or along the circumference of heat source 20. The air flow passageways should have a large geometric surface area to improve the heat transfer to the air flowing through the heat source. The shape and number of the passageways should be chosen to maximize the internal geometric surface area of heat source 20. Preferably, when longitudinal air flow passageways such as those depicted in FIG. 1 are used, maximization of heat transfer to the flavor bed is accomplished by forming each longitudinal air flow passageway 22 in the shape of a multi-pointed star. Even more preferably, as set forth in FIG. 1, each multi-pointed star should have long narrow points and a small inside circumference defined by the innermost edges of the star. These star-shaped longitudinal air flow passageways provide a larger area of heat source 20 available for combustion, resulting in a greater volume of metal carbide involved in combustion, and therefore a hotter burning heat source.

A certain minimum amount of metal carbide is needed in order for smoking article 10 to provide a similar amount of static burn time and number of puffs to the smoker as a conventional cigarette. Typically, the amount of heat source 20 that is converted to metal oxide is about 50% of the volume of a heat source cylinder that is 10 mm long by 4.65 mm in diameter. A greater amount may be needed taking into account the volume of heat source 20 surrounded by and in front of mounting structure 24 which, as discussed above, is not combusted.

Heat source 20 should have a density of from about 25% to about 75% of the theoretical maximum density of the metal carbide. Preferably, the density should be between about 30% and about 60% of its theoretical maximum density. The optimum density maximizes both the amount of carbide and the availability of oxygen at the point of combustion. If the density becomes too high the void volume of heat source 20 will be low. Lower void volume means that there is less oxygen available at the point of combustion. This results in a heat source that is harder to burn. However, if a catalyst is added to heat source 20, it is possible to use a dense heat source, i.e., a heat source with a small void volume having a density approaching 90% of its theoretical maximum density.

Certain additives may be used in heat source 20 to modify the smoldering characteristics of the heat source. This aid may take the form of promoting combustion of the heat source at a lower temperature or with lower concentrations of oxygen or both.

Heat source 20 can be manufactured by slip casting, extrusion, injection molding, die compaction or used as a contained, packed bed of small individual particles.

Any number of binders could be used to bind the metal carbide particles together when the heat source is made by extrusion or die compaction, for example sodium carboxymethylcellulose (SCMC). The SCMC may be used in combination with other additives such as sodium chloride, vermiculite, bentonite or calcium carbonate. Other binders useful for extrusion or die compaction of the metal carbide heat sources of this invention include gums, such as guar gum, other cellulose derivatives, such as methylcellulose and carboxymethylcellulose, hydroxypropyl cellulose, starches, alginates and polyvinyl alcohols.

Varying concentrations of binders can be used, but it is desirable to minimize the binder concentration to reduce the thermal conductivity and improve the burn characteristic of the heat source. It is also important to minimize the amount of binder used to the extent that combustion of the binder may liberate free carbon which could then react with oxygen to form carbon monoxide.

The metal carbide used to make heat source 20 is preferably iron carbide. A suitable iron carbide has the formula $Fe_5C_2$. Other useful iron carbides have the formula $Fe_3C$, $Fe_4C$, $Fe_7C_2$, $Fe_9C_4$ and $Fe_{20}C_9$, or mixtures thereof. These mixtures may contain a small amount of carbon. The ratio of iron molecules to carbon molecules in the iron carbide will affect the ignition temperature of the iron carbide.

Other metal carbides suitable for use in the heat source of this invention include carbides of aluminum, titanium, tungsten, manganese and niobium, or mixtures thereof.

Preparation Of Iron Carbide

Iron carbide was synthesized using a variation of the method disclosed in J. P. Senateur, *Ann. Chem.*, vol. 2, p. 103 (1967). That method involved the reduction and carburization of high surface area reactive iron oxide ($Fe_2O_3$) using a mixture of hydrogen and carbon monoxide gases. Methods such as thermal degradation of iron oxylate or iron citrate are well-known. P. Courty and B. Delmon, *C.R. Acad. Sci. Paris Ser. C.*, vol. 268, pp. 1874–75 (1969). The particular iron carbide prepared depends on the temperature of the reaction mixture and the ratio of the hydrogen and carbon monoxide gases. Reaction temperatures of between 300 and 350 degrees centigrade yield $Fe_5C_2$, whereas primarily $Fe_3C$ will be produced at temperatures greater that 350 degrees centigrade. The ratio of hydrogen to carbon monoxide can be varied from 0:1 to 10:1, depending on the temperature. This ratio was controlled using two separate flowmeters connected to each gas source. The combined flow was 70 standard cubic centimeters per minute.

1. Synthesis of $Fe_5C_2$

High surface area iron oxide was prepared by heating iron nitrate ($Fe(NO_3)_3 9H_2O$) in air at 400 degrees centigrade. The iron oxide was then carburized by placing it in a furnace at 300 degrees centigrade under flowing hydrogen-carbon monoxide gas mixture at a ratio of 7 to 1 for twelve hours to produce the iron carbide. If desired, a hydrogen-methane gas mixture can be used in place of the hydrogen-carbon monoxide gas mixture. The iron oxide sample had an X-ray powder diffraction pattern indicative of $Fe_5C_2$, as compared to the JCPDS X-Ray Powder Diffraction File. The sample was grayish-black in color.

2. Synthesis of $Fe_3C$

This sample was prepared using similar procedures to those described for production of $Fe_5C_2$, except that the iron oxide was carburized at 500 degrees centigrade. X-ray powder diffraction analyses confirmed that primarily $Fe_3C$ was produced.

3. Analyses of Iron Carbides

We determined the B.E.T. surface area (using nitrogen gas), ignition temperature and heat of combustion of the iron carbides produced by the above methods. The results were as follows:

| | B.E.T. Surface Area | Ignition Temperature | Heat Of Combustion |
|---|---|---|---|
| $Fe_5C_2$ | 26 $m^2/gr$ | 155° C. | 2400-2458 Cal/gr |
| $Fe_3C$ | 20 $m^2/gr$ | 380° C. | — |

Gas phase analyses indicated that the $CO_2/CO$ gas ratio was 30:1 by weight for $Fe_5C_2$, whereas the ratio for carbon is 3:1 by weight. Thus 10 times less carbon monoxide is produced upon combustion of the $Fe_5C_2$ sample than of carbon.

Thus, it is seen that this invention provides a metal carbide heat source that forms virtually no carbon monoxide gas upon combustion and has a significantly lower ignition temperature than conventional carbonaceous heat sources, while at the same time maximizes heat transfer to the flavor bed. One skilled in the art will appreciate that the present invention can be practiced by other than the described embodiments, which are presented herein for the purpose of illustration and not of limitation, and that the present invention is limited only by the claims which follow.

What we claim is:

1. A heat source for use in a smoking article comprising iron carbide.

2. The heat source of claim 1 comprising metal carbide and carbon.

3. A heat source comprising iron carbide.

4. The heat source of any of claims 1, 2 and 3, wherein the metal carbide has the formula $Fe_5C_2$.

5. The heat source of any of claims 1, 2 and 3, wherein the metal carbide has the formula $Fe_3C$.

6. The heat source of any of claims 1, 2 and 3, wherein the heat source is substantially cylindrical in shape and has one or more fluid passages therethrough.

7. The heat source of claim 6, wherein the fluid passages are formed as grooves around the circumference of the heat source.

8. The heat source of claim 6, wherein the fluid passages are formed in the shape of a multi-pointed star.

9. The heat source of any of claims 1, 2 and 3, wherein the heat source contains at least one burn additive.

10. The heat source of any of claims 1, 2 and 3, wherein the metal carbide particles have a size of up to about 700 microns.

11. The heat source of any of claims 1, 2 and 3, wherein the metal carbide particles have a size in the range of submicron to about 300 microns.

12. The heat source of any of claims 1, 2 and 3, wherein the metal carbide particles have a B.E.T. surface area in the range of about 1 $m^2/gr$ to about 200 $m^2/gr$.

13. The heat source of any of claims 1, 2 and 3, wherein the metal carbide particles have a B.E.T. surface area in the range of about 10 $m^2/gr$ to about 100 $m^2/gr$.

14. The heat source of any of claims 1, 2 and 3, having a void volume of about 25% to about 75%.

15. The heat source of any of claims 1, 2 and 3, having a pore size of about 0.1 micron to about 100 microns.

16. The heat source of any of claims 1, 2 and 3, having a density of about 0.5 gr/cc to about 5 gr/cc.

17. The heat source of any of claims 1, 2 and 3, having a density of about 1.8 gr/cc to about 2.5 gr/cc.

18. The heat source of any claims 1, 2 and 3, having an ignition temperature of between about room temperature to about 550 degrees centigrade.

* * * * *